United States Patent [19]

Hart, Jr.

[11] Patent Number: 4,819,838

[45] Date of Patent: Apr. 11, 1989

[54] SPRAY TUBE AND SUPPORT ASSEMBLY FOR SPRAY CONTAINER

[76] Inventor: Charles R. Hart, Jr., 919 Santa Monica Blvd., Ste. 300, Santa Monica, Calif. 90406

[21] Appl. No.: 35,888

[22] Filed: Apr. 8, 1987

[51] Int. Cl.[4] ..... B05B 15/06

[52] U.S. Cl. ..... 222/538; 239/282; 239/337

[58] Field of Search ..... 239/273, 282, 337; 222/530, 538; 248/312, 312.1

[56] References Cited

U.S. PATENT DOCUMENTS

| | | | |
|---|---|---|---|
| 1,284,822 | 11/1918 | Tumey | 222/538 |
| 2,364,164 | 12/1944 | Pitts | 222/530 |
| 2,395,734 | 2/1946 | Georgopoulos . | |
| 2,515,523 | 7/1950 | Mancino | 248/312.1 |
| 3,109,563 | 11/1963 | Morales . | |
| 3,130,519 | 4/1964 | Mauget | 239/337 |
| 3,253,786 | 5/1966 | Parmelee | 239/337 |
| 3,732,591 | 5/1973 | Gach | 222/192 |
| 3,754,831 | 8/1973 | Hutter | 401/139 |
| 3,961,729 | 6/1976 | Grimm | 222/192 |
| 4,096,974 | 6/1978 | Haber | 222/530 |
| 4,305,528 | 12/1981 | Craig | 222/530 |
| 4,664,300 | 5/1987 | Strickland | 222/530 |

FOREIGN PATENT DOCUMENTS

| | | | |
|---|---|---|---|
| 2381683 | 9/1978 | France | 222/538 |

*Primary Examiner*—Andres Kashnikow
*Assistant Examiner*—Karen B. Merritt
*Attorney, Agent, or Firm*—Kelly, Bauersfeld & Lowry

[57] ABSTRACT

A combined spray tube and support assembly is provided for use with a spray container such as an aerosol can and the like. The assembly comprises an elongated spray tube adapted for removable seating within a discharge port of a spray nozzle unit on the spray container. When separated from the spray nozzle unit, the spray tube is removably retained by a support member on the spray container or on a cap for the spray container. In a preferred form, the support member comprises a vertically open support ring on the cap which cooperates with short outwardly projecting tabs near one end of the spray tube to support the spray tube alongside the spray container, with the tabs facilitating manipulation to seat the spray tube within the nozzle discharge port.

11 Claims, 1 Drawing Sheet

FIG. 1
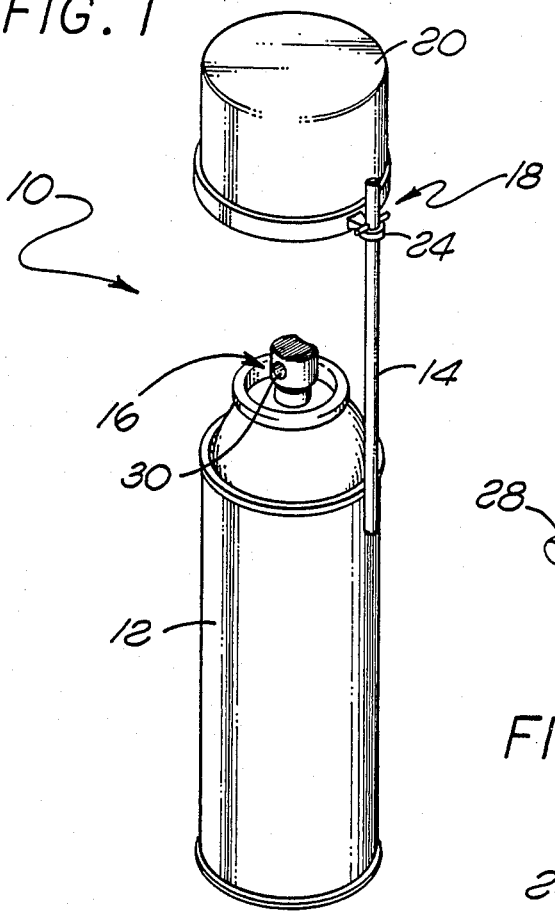
FIG. 2
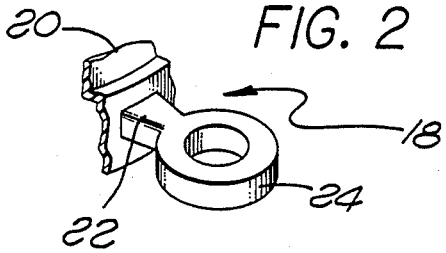
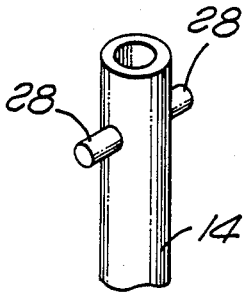
FIG. 3
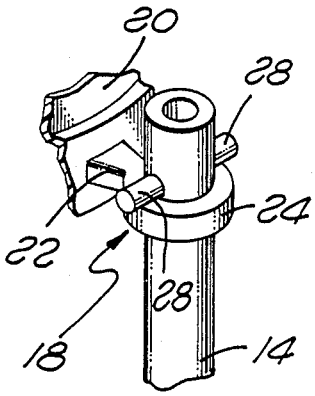
FIG. 4
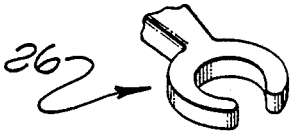
FIG. 5
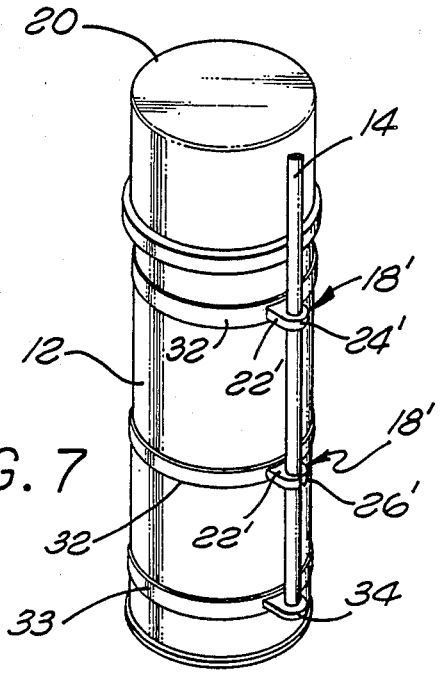
FIG. 7
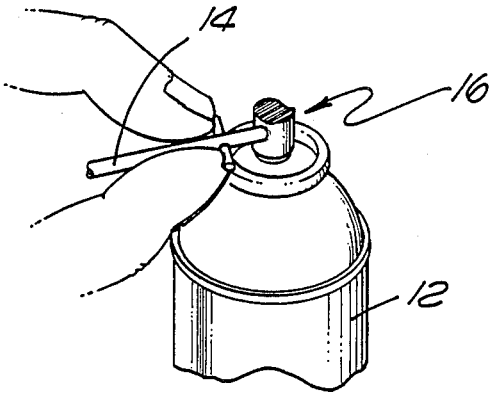
FIG. 6

SPRAY TUBE AND SUPPORT ASSEMBLY FOR SPRAY CONTAINER

BACKGROUND OF THE INVENTION

This invention relates generally to an improved and relatively simple apparatus for supporting an elongated spray tube with respect to a spray container such as an aerosol can or the like. More particularly, this invention relates to a simplified spray tube and related support assembly for removably storing the spray tube with the spray container in a manner protected against inadvertent loss.

Spray containers such as aerosol cans and the like are well known in the art for containing and spraying a wide range of fluids such as lubricants, cleaning solutions, insecticides, etc. In many spray containers, particularly such as conventional aerosol cans, the fluid is contained under pressure for controlled release upon operation of a spray nozzle unit typically mounted at the top of the spray container. A cap of lightweight molded plastic is normally provided for covering and protecting the spray nozzle unit during shipment or storage, and between uses of the spray container.

In some spray container applications, an elongated spray tube of lightweight flexible plastic is provided for use in directing the discharged fluid to a specific location, or to insure fluid discharge as a discrete thin liquid stream. In such applications, the elongated spray tube is normally sold with the spray container, with the spray tube typically being attached by adhesive tape onto the exterior of the spray container. When use is desired, the spray tube is removed from the container and one end of the spray tube is seated within a nozzle discharge port for in-line guided passage of the sprayed fluid. Such nozzle installation of the spray tube requires prior removal of the protective cap from the container; similarly, subsequent replacement of the cap after use requires the spray tube to be removed from the nozzle unit. Desirably, when the spray tube is removed from the spray nozzle unit, the spray tube is reattached onto the spray container for storage and ready for subsequent use. Unfortunately, however, in many instances, the spray tube is intentionally or negligently not reattached to the spray container, or reattachment is rendered impossible due to failure of the adhesive tape to stick to the container. Failure to reattach the spray tube to the container frequently results in the spray tube becoming lost and thus unavailable when subsequent use is desired.

In the prior art, a variety of nozzle unit and/or cap assembly constructions have been proposed for supporting an elongated spray tube with respect to the spray container, with a view toward preventing spray tube loss between uses. Some of these proposals utilize special cap constructions in combination with specialized spray tube configurations to accommodate installation of a protective cap without requiring spray tube removal between uses. See, for example, U.S. Pat. No. 4,305,528. Other such arrangements have suggested rotating specialized cap structures designed to wind a flexible spray tube between a normal outwardly projecting position for operation and a stored spiral shape concealed within the cap. See, for example, U.S. Pat. No. 4,096,974. However, in these various proposals, the cap structures and/or related spray tubes have been relatively complicated in construction and/or have required a significant number of mechanical components resulting in significant increases in the overall cost of the spray container product.

There exists, therefore, a need for an improved arrangement for removably and conveniently storing an elongated spray tube with respect to a spray container such as an aerosol can. The present invention fulfills these needs and provides further related advantages.

SUMMARY OF THE INVENTION

In accordance with the invention, an improved spray tube and support assembly is provided for use with a spray container to provide easy, convenient and safe removable storage of an elongated spray tube alongside the spray container. The spray tube is quickly and easily removed from the stored position for use, and then quickly and easily returned to the stored position between uses.

The spray tube and support assembly are provided for use with a spray container such as an aerosol can or the like having a spray nozzle unit with a discharge port for outward projection of a fluid within the container. The assembly includes a lightweight and typically flexible plastic spray tube adapted for inserted mounting of one end thereof into the nozzle discharge port and for subsequent in-line guided passage of the sprayed fluid to a specific location.

The spray tube is further adapted for removable mounting in the stored position alongside the spray container by means for a support member formed, in accordance with the preferred form of the invention, as an integral portion of a protective cap for the container. The preferred support member comprises a support ring or clamp projecting outwardly from the cap for receiving the spray tube in a generally vertical orientation alongside the spray container. When a support ring is used, the spray tube is provided with short, outwardly projecting tabs near one end of the spray tube and sized to rest upon the support ring thereby holding the spray tube in place. Conveniently, these support tabs are easily grasped for facilitated manual spray tube handling during insertion thereof into the discharge port of the spray nozzle unit.

In alternative preferred forms of the invention, one or more support members such as rings or clamps can be mounted directly onto the spray container, by means of circular mounting bands or the like. Once again, such support member or members are designed to store the spray tube closely alongside the spray container. When one or more support rings are used, a lower support member defining a support platform can be provided for vertically supporting the lower end of the spray tube.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is an exploded perspective view illustrating the spray tube and support assembly embodying the novel features of the invention, and shown for use with a spray container such as an aerosol can;

FIG. 2 is an enlarged fragmented perspective view depicting a support member on a protective cap provided with the spray container;

FIG. 3 is an enlarged fragmented perspective view illustrating one end of a spray tube forming a portion of the assembly;

FIG. 4 is a fragmented perspective view illustrating the support member removably supporting the spray tube;

FIG. 5 is a fragmented perspective view illustrating an alternative support member geometry;

FIG. 6 is a fragmented perspective view illustrating removable mounting of the spray tube onto a spray nozzle unit of the spray container; and FIG. 7 is a perspective view illustrating a further alternative form of the invention.

DETAILED DESCRIPTION OF THE PREFERRED EMBODIMENTS

As shown in the exemplary drawings, an improved spray tube and support assembly referred to generally by the reference numeral 10 in FIG. 1 is provided for use with a spray container 12 particularly such as the illustrative aerosol can. The spray tube and support assembly 10 includes relatively simple, inexpensive and easy-to-use means for removably supporting an elongated spray tube 14 in a convenient position stored alongside the spray container 12.

The improved spray tube and support assembly 10 is designed for convenient spray tube storage when the spray tube 14 is not in use, thereby minimizing or eliminating loss of the spray tube. The support means retains the spray tube 14 safely and accessibly alongside the spray container 12 where it is available for mounting quickly and easily onto a container spray nozzle unit 16 when use is desired, as viewed in FIG. 6. During such use, the spray tube provides a convenient tubular path for guiding a sprayed fluid from the nozzle unit 16 to a specific location whereat the fluid is desired, for example, to spray lubricant or cleaning solution onto precise areas of mechanical components or to spray insecticide or other solution into hard-to-reach areas. After use, the mounting means accommodates easy return of the spray tube to the stored position where it is readily accessibly without significant risk of loss.

As shown generally in FIGS. 1 and 2, the preferred support means comprises a support member 18 formed as a portion of a protective cap 20 for the spray container. More particularly, the cap 20 is typically constructed from a lightweight molded plastic or the like with a size and shape to snap-fit or the like onto the upper end of the spray container. The cap 20 is thus designed to fit over and protect the spray nozzle unit 16 during shipment and/or storage of the container between uses.

The support member 18 is preferably molded as an integral portion of the cap 20, to include a short support arm 22 projecting outwardly from a lower rim of the cap, as viewed in FIGS. 1 and 2. The outboard end of the support arm 22 terminates in an outer support ring 24 having a size and shape for relatively close sliding reception of the support tube 14, which is typically formed from a lightweight flexible plastic extrusion or the like. Importantly, as shown best in FIG. 1, the support ring 24 is oriented for receiving the spray tube 14 in a generally vertical orientation extending alongside, and generally in parallel with a central axis of the spray container. Alternatively, if desired, the support ring may be truncated to a part circle configuration thereby defining an outwardly open, generally U-shaped clamp 26, as viewed in FIG. 5.

A pair of relatively short support tabs 28 are formed on the exterior of the spray tube 14 near one end thereof, as shown best in FIGS. 1 and 3. These support tabs 28 extend radially outwardly from a central axis of the spray tube in generally diametrically opposite directions, with an overall size and shape to rest upon the support ring 24 (or clamp 26) when the spray tube 14 is received downwardly therethrough. Accordingly, the support tabs 28 provide relatively simple structure cooperating with the support ring 24 to secure the spray tube 14 in a removable manner with respect to the cap 20. Accordingly, when the cap 20 is mounted in its normal position over the top of the spray container 12, the support ring 24 removably retains the spray tube 14 in a position lying closely alongside the spray container.

When use of the spray tube 14 is desired, as previously described, the spray tube 14 can be withdrawn quickly and easily from the support ring 24 and installed into the nozzle unit 16. More specifically, as shown in FIG. 6, the upper end of the spray tube 14 is easily handled manually for insertion into an open discharge port 30 in the nozzle unit 16. Such manual handling is facilitated by the support tabs 28 which enhance the ease of grasping and manipulation. The spray container can then be used by conventional depression of the nozzle unit 16 to release fluid contents stored within the container for flow through the nozzle unit and further for in-line passage through the spray tube 14 to the prescribed point of fluid application. When a spraying task is completed, the spray tube 14 is easily removed from the nozzle unit and returned to the normally stored position rested upon the support ring 24, as viewed in FIGS. 1 and 4.

In one alternative form of the invention, when the U-shaped clamp 26 is used as the support member on the cap 20, as viewed in FIG. 5, the clamp 26 can be sized for snug friction retention of the spray tube 14 when an upper end of the tube is inserted into the clamp. In this configuration, the spray tube may be supported entirely by the gripping action of the clamp, without requiring the use of the support tabs 28 on the end of the tube.

In another alternative form of the invention, as viewed in FIG. 7, a support member or members can be mounted directly on the spray container, in lieu of mounting on the protective cap 20. More particularly, one or more support members 18' may be mounted directly onto the spray container 12 by the use of appropriate mounting means such as the illustrative encircling mounting bands 32 sized to fit snugly about the circumference of the spray container. In this form of the invention, the use of multiple support members 18' each including a support arm 22' with a circular support ring 24' or a support clamp 26' may be used to define multiple vertically open, aligned bores for vertically extending passage of the spray tube. When a clamp 26' is used, as depicted with respect to one of the support members in FIG. 7, the clamp 26' may be sized for releasably gripping the spray tube, thereby eliminating the need for other support structures. Alternatively, a lower support platform 34 can be provided on a lower mounting band 33 to support the lower end of the spray tube received through one or more support rings 24', in which case the spray tube tabs as shown and described with respect to FIGS. 1, 3 and 4 may again be eliminated.

Accordingly, the spray tube and support assembly of the present invention provides relatively simple and easy-to-use apparatus for supporting a spray tube of the type commonly provided with many aerosol can products. The spray tube is securely and safely mounted in a low profile position alongside the spray container in a position ready for use whenever desired. Moreover, after use, the spray tube is quickly and easily returned to the stored position alongside the container to permit recapping of the container for safe storage, and to retain the spray tube against loss.

A variety of further modifications and improvements to the improved spray tube and support assembly of the present invention will be apparent to those skilled in the art. Accordingly, no limitation on the invention is intended by way of the description herein, except as set forth in the appended claims.

What is claimed is:

1. A spray tube and support assembly for use in combination with a spray container having a spray nozzle unit for outward discharge of fluid from the spray container, and a protective cap for mounting onto the spray container in a position over the spray nozzle unit, said assembly comprising:

a support member carried by said protective cap, said support member including a relatively short outwardly projecting support arm terminating in an upwardly open support ring member; and an elongated spray tube having a size and shape for mounting onto said spray nozzle unit for in-line passage of fluid discharged from said spray container, said spray tube further having a size for sliding reception through said support ring member and including at least one outwardly radiating tab near one end thereof, said tab resting upon said support ring member when said spray tube is received therethrough to support said spray tube relative to said container when said cap is mounted on said container.

2. The combination of claim 1 wherein said at least one tab comprises a pair of support tabs extending diametrically outwardly in opposite radial directions from said spray tube.

3. The combination of claim 1 wherein said support ring member comprises an annular support ring.

4. The combination of claim 1 wherein said support ring member comprises a generally U-shaped clamp.

5. The combination of claim 1 wherein said support ring member is formed integrally with said protective cap.

6. The combination of claim 1 wherein said spray nozzle unit includes a discharge port formed therein, said one end of said spray tube being sized for reception into said discharge port.

7. A spray tube and support assembly for use in combination with a spray container having a spray nozzle unit for outward discharge of fluid from the spray container, and a protective cap for mounting over the spray nozzle unit, said assembly comprising:

a support member formed integrally with said cap, said support member including a relatively short support arm terminating in an upwardly open support ring member; and an elongated spray tube having a size and shape for mounting onto spray nozzle unit for in-line passage of fluid discharged form said spray container, said spray tube further having a size for sliding reception through said support ring member and including a pair of outwardly radiating support tabs near one end thereof for facilitating manual handling of said tube during mounting thereof onto said spray nozzle unit and for resting upon said support ring to retain said spray tube removably in a stored position extending alongside said spray container.

8. The combination of claim 7 wherein said support ring member comprises a generally U-shaped clamp for gripping support of said spray tube.

9. A spray tube and support assembly for use in combination with a spray container having a spray nozzle unit for outward discharge of a fluid from the spray container, said assembly comprising:

at least one support member including a relatively short support arm projecting outwardly from said container, a first mounting band sized for relatively snug reception about said container and carrying said support arm, and said support arm terminating in an upwardly open support ring member;

an elongated spray tube having a size and shape for mounting onto said spray nozzle unit for in-line passage of the fluid discharged from said container, said spray tube further having a size for sliding reception through and support by said support ring member; and a lower platform member and a second mounting band sized for relatively snug reception about said container for mounting said lower platform member onto said spray container in a position generally vertically aligned with said support ring member, said lower platform member supporting a lower end of said spray tube.

10. The combination of claim 9 wherein said at least one support member comprises a plurality of said support members each defining an upwardly open support ring member arranged in vertical alignment with each other.

11. The combination of claim 9 wherein said support ring member comprises a generally U-shaped clamp for gripping support of said spray tube.

* * * * *